United States Patent [19]

Koch et al.

[11] 4,113,642

[45] Sep. 12, 1978

[54] HIGH VISCOSITY NEUTRAL POLYESTER LUBRICANTS

[75] Inventors: Karlheinz Koch, Haan; Willi Breitzke, Dusseldorf-Holthausen, both of Fed. Rep. of Germany

[73] Assignee: Henkel Kommanditgesellschaft auf Aktien, Dusseldorf-Holthausen, Fed. Rep. of Germany

[21] Appl. No.: 741,160

[22] Filed: Nov. 11, 1976

[51] Int. Cl.[2] ..... C10M 3/20

[52] U.S. Cl. ..... 252/56 S

[58] Field of Search ..... 252/56 S

[56] References Cited

U.S. PATENT DOCUMENTS

| | | | |
|---|---|---|---|
| 2,757,139 | 7/1956 | Matuszak et al. | 252/56 S |
| 2,950,250 | 8/1960 | Fainman | 252/56 S |
| 3,047,504 | 7/1962 | Peters et al. | 252/56 S |
| 3,048,542 | 8/1962 | Tierney et al. | 252/56 S |
| 3,189,629 | 6/1965 | Huttenlocher et al. | 252/56 S |
| 3,247,111 | 4/1966 | Oberright et al. | 252/56 S |
| 3,429,817 | 2/1969 | Furey et al. | 252/56 S |
| 3,526,596 | 9/1970 | Kress et al. | 252/56 S |
| 3,778,454 | 12/1973 | Kleiman et al. | 252/56 S |
| 3,923,702 | 12/1975 | Sturwold et al. | 252/56 S |
| 4,036,771 | 2/1978 | Denis et al. | 252/56 S |

FOREIGN PATENT DOCUMENTS

| | | | |
|---|---|---|---|
| 847,399 | 9/1960 | United Kingdom | 252/56 S |

*Primary Examiner*—Delbert E. Gantz
*Assistant Examiner*—Joan Thierstein
*Attorney, Agent, or Firm*—Hammond & Littell

[57] ABSTRACT

A high viscosity neutral complex polyester lubricant reaction product produced by esterifying a mixture of (a) branched alkanepolyols having 2 to 4 primary hydroxyls and 4 to 10 carbon atoms, (b) polyacids selected from the group consisting of dimeric fatty acids and trimeric fatty acids derived by polymerization of unsaturated fatty acids having 16 to 18 carbon atoms, (c) alkanoic acids having 6 to 16 carbon atoms, the acid number of said polyester being 0.3 or below and the hydroxyl number of said polyester being below 0.5, the proportion of hydroxyl groups esterified by said alkanoic acids being from 50% to 90%. The said complex polyester lubricant having a low pour point, a high viscosity and a high viscosity index.

8 Claims, No Drawings

HIGH VISCOSITY NEUTRAL POLYESTER LUBRICANTS

THE RELATED ART

Synthetic esters, the so-called ester oils, have been increasingly used in recent years as high-grade lubricating oils. Thus, diesters of dicarboxylic acids with monovalent alcohols, such as dioctyl sebacate or dinonyl adipate, or esters of polyols with monocarboxylic acids, such as trimethylol propane tripelargonate, have been proposed as lubricants for aircraft turbines. In recent times, so-called complex esters have also been developed for lubricating problems of this type. In addition to polyhydric alcohols, such as trimethylolpropane or neopentylglycol, these complex esters contain, as esterification components, monocarboxylic acids having 6 to 10 carbon atoms, and dicarboxylic acids, such as sebacic acid or azelaic acid. The suitability of the synthetic esters as lubricants results from the fact that they have a more favorable viscosity/temperature behavior than conventional lubricants based on mineral oils, and that upon adjusting to comparable viscosities, the pour points are distinctly lower. However, for many ranges of application, for example, for the new multigrade transmission oil class 80 W-90 (see U.S. Military Specification Mil-L-2105 C), which requires highly viscous transmission oils having viscoxity values of at least 14 cSt at 210° F and a maximum of 150,000 cP at −15° F, the known synthetic esters are unsuitable owing to their limited viscosity properties.

On the other hand, however, lubricating oils based on mineral oils, and which have adequate viscosity properties can only be manufactured by adding polymers, such as a styrene/butadiene copolymer (German Auslegeschrift No. 1,811,516). When adding copolymers to increase the viscosity of transmission oils, one disadvantage is the shearing sensitivity of the polymers. As a result of shearing, i.e., by irreversible fracture of the polymers, considerable reductions in the viscosity of the corresponding oils occur.

OBJECTS OF THE INVENTION

An object of the present invention is the development of a synthetic ester oil which, in addition to having a low pour point, has a high viscosity and a satisfactory viscosity/temperature behavior (high viscosity index).

Another object of the present invention is the development of a high viscosity neutral complex polyester lubricant produced by esterifying a mixture of (a) a branched alkanepolyol having 2 to 4 primary hydroxyls and 4 to 10 carbon atoms, (b) polyacids selected from the group consisting of dimeric fatty acids and trimeric fatty acids produced by the dimerization of unsaturated fatty acids having 16 to 18 carbon atoms, and (c) alkanoic acids having 6 to 16 carbon atoms, in such proportions that the acid number of said polyester is 0.3 or below, the hydroxyl number of said polyester is 0.5 or below, and the proportion of said hydroxyl groups being esterified by said alkanoic acid is from 50% to 90%.

These and other objects of the invention will become more apparent as the description thereof proceeds.

DESCRIPTION OF THE INVENTION

The present invention relates to novel, highly viscous neutral complex esters of polyols with polymeric fatty acids and aliphatic monocarboxylic acids, and their use in lubricating oils.

More particularly, we have now discovered that the requirements of a high viscosity lubricant with a low pour point have been met, to an extent not hitherto attained, by novel, neutral complex esters derived from:

(a) polyvalent, branched, aliphatic alcohols having 2 to 4 primary hydroxy groups and 4 to 10 carbon atoms, (b) dimeric and/or trimeric fatty acids produced by polymerization of unsaturated fatty acids having 16 to 18 carbon atoms, and (c) saturated straight chain or branched chain, aliphatic monocarboxylic acids having 6 to 16 carbon atoms, the proportion of the hydroxy groups esterified by monocarboxylic acids being 50% to 90%.

Our invention is, therefore, a high viscosity neutral complex polyester lubricant produced by esterifying a mixture of (a) a branched alkanepolyol having 2 to 4 primary hydroxyls and 4 to 10 carbon atoms, (b) polyacids selected from the group consisting of dimeric fatty acids and trimeric fatty acids produced by the dimerization of unsaturated fatty acids having 16 to 18 carbon atoms, and (c) alkanoic acids having 6 to 16 carbon atoms, in such proportions that the acid number of said polyester is 0.3 or below, the hydroxyl number of said polyester is 0.5 or below and the proportion of said hydroxyl groups being esterified by said alkanoic acid is from 50% to 90%.

The alcoholic component forming the basis of the highly viscous, neutral complex esters in accordance with the present invention can be any branched, aliphatic polyol having 2 to 4 primary hydroxy groups and 4 to 10 carbon atoms, more particularly a branched alkanepolyol having 2 to 4 primary hydroxyls and 4 to 10 carbon atoms, such as neopentyl glycol, trimethylolethane, trimethylolpropane or pentaerythritol. The trihydric alcohol trimethylolpropane is particularly important.

The polycarboxylic acid component is a mixture of polyacids selected from the group consisting of dimeric fatty acids and trimeric fatty acids produced by the dimerization of unsaturated fatty acids having 16 to 18 carbon atoms. The mixtures of dimeric and trimeric fatty acids produced by dimerization of olefinically-unsaturated fatty acids having 16 to 18 carbon atoms are preferred as the polymeric fatty acids, and those wherein the mixtures have a content of 75% by weight, and in excess thereof, of dimeric fatty acids are preferred. Such mixtures of polymeric fatty acids are obtained, for example, by thermal polymerization of olefinically-unsaturated fatty acids, such as oleic acid, linoleic acid or linolenic acid or fatty acid mixtures having a content of olefinically-unsaturated fatty acids, such as the fatty acids obtained from soybean oil or tall oil, at temperatures of approximately 200° C to 300° C in the presence of small quantities of water and a mineral catalyst such as montmorillonite.

The monocarboxylic acid component of the neutral complex esters in accordance with the present invention may comprise a wide variety of saturated, straight chain or branched chain, aliphatic monocarboxylic acids or alkanoic acids having 6 to 16 carbon atoms. By way of example, fatty acids, such as capronic acid, caprylic acid, capric acid, lauric acid, myristic acid or palmitic acid and mixtures thereof, are suitable. Preference is given to mixtures of saturated fatty acids having 6 to 12 carbon atoms, which, for example, are produced as pre-run fatty acids during the distillation of coconut fatty acids.

Branched chain monocarboxylic acids which have proved to be particularly advantageous are the alkanoic acids, having 12 to 16 carbon atoms, branched in the α-position to the carboxyl group. Carboxylic acids of this type can be produced by, for example, Guerbetizing of medium chain length, unbranched, saturated alcohols and subsequent oxidation of the alcohols which are obtained. These acids are branched in the second or α-position and have a corresponding total number of carbon atoms. An isopalmitic acid manufactured in this manner by oxidation of 2-hexyldecanol was preferred as the monocarboxylic acid component in the complex esters in accordance with the present invention.

The complex esters, in accordance with the present invention, of branched alkanepolyols having 2 to 4 primary hydroxy groups, polymeric, substantially dimeric, fatty acids and saturated, straight chain or branched chain alkanoic acids can be produced in accordance with known esterification processes by heating the reactants (to 200° C in a nitrogen atmosphere) in the presence of an esterification catalyst such as powdered tin, p-toluene sulfonic acid or others, while removing the water formed. Alternatively, esterification can be effected in two stages, the alcoholic component being reacted with dimeric fatty acids in the first step and being further esterified with the monocarboxylic acid after partial reaction has been completed. Preferably a slight excess of the alkanoic acid is employed. For the purpose of purifying the product of esterification, the latter may be treated with an additive of 1% to 5% by weight of activated bleaching clay. Any free monocarboxylic acid which is still present can be removed by distillation, so that complex esters are produced whose acid numbers lie below 0.3 and whose hydroxyl numbers are below 0.5.

Owing to their excellent properties, namely, their high viscosity, their low pour point and their favorable viscosity/temperature behavior, the neutral complex esters in accordance with the present invention are eminently suitable for use as lubricants, particularly for transmission fluid and lubricants for two-stroke piston engines.

The complex esters in accordance with the present invention may constitute the sole oil base in the finished lubricant, or they may be mixed as a mixture component with other products which are already known for this purpose. When used as mixing components in lubricant and transmission oils, any optional quantity ratios may be mixed which are determined exclusively by the required properties such as viscosity pour point, and viscosity/temperature behavior. However, the content of complex esters will not usually be below 10%, and preferably not below 30%, by weight in the finished product. Various additives such as oxidation and corrosion inhibitors, dispersing agents, high pressure additives, anti-foaming agents, metal deactivators and other additives suitable for use in lubricant formulations based on synthetic esters, can be added in conventional effective quantities.

The following examples are intended to further illustrate the present invention, but without limiting the invention thereof.

EXAMPLE 1

Production of the Neutral Complex Esters 268 gm (2 mols) of trimethylolpropane, 565 gm (approximately 1 mol) of dimeric fatty acid (a mixture of approximately 95% by weight of dimerized fatty acids, approximately 4% by weight of trimerized fatty acids, and approximately 1% by weight of non-polymerized unsaturated fatty acids, the starting unsaturated fatty acid being a mixture of olefinically unsaturated fatty acids having 16 to 18 carbon atoms), and 632 gm (approximately 4 mols) of $C_6$ to $C_{12}$ saturated fatty acids (a mixture of approximately 5% by weight of $C_6$ fatty acids, approximately 45% by weight of $C_8$ fatty acids, approximately 45% by weight of $C_{10}$ fatty acids, and approximately 5% by weight of $C_{12}$ fatty acids as obtained from the distillation of coconut fatty acid), were heated to 200° C in an autoclave provided with a water separator under passage of nitrogen, the nitrogen acting as a carrier gas to flush out the water of reaction. A mixture of powdered tin 1.5 gm and p-toluene sulfonic acid 1.5 gm was used as an esterification catalyst. Towards the end of the reaction, further esterification was carried out at the same temperature, but under reduced pressure (approximately 70 torr). After cooling to 120° C, 1.5 gm (approximately 1% by weight) of activated bleaching clay were added and the mixture was again heated to 200° C and the surplus monocarboxylic acid was distilled off in vacuo. The acid number of the product A of esterification (the proportion esterified with monocarboxylic acid was 67%) was 0.28. The product had a viscosity of 628 cSt at 37.8° C = (100° F), and 57 cSt at 99° C = (210° F). The viscosity index was 164 and the pour point was −38° C. The complex esters given in the following Table I were produced in conformity with the above method.

TABLE I

NEUTRAL COMPLEX ESTERS PRODUCED

| Example | Product | Polyol (1 Mol) | Polymerized Fatty Acid | Mols | Monocarboxylic Acid | Proportion Esterified Therewith | Viscosity (cSt) 37.8° | Viscosity (cSt) 99° C | Viscosity Index | Pour Point (0° C) | Acid Number |
|---|---|---|---|---|---|---|---|---|---|---|---|
| | | | Dimer 1* | | | | | | | | |
| 2 | B | Trimethylolpropane | 0.35 mol | 2.3 | $C_6$—$C_{12}$—FS*** | 77% | 213 | 25 | 156 | −50 | 0.2 |
| 3 | C | " | 0.25 mol | 2.5 | " | 83% | 113 | 16 | 152 | −59 | 0.2 |
| | | Trimethyl- | Dimer 2** | | | | | | | | |
| 4 | D | olpropane | 0.3 mol | 2.4 | $C_6$—$C_{12}$—FS*** | 80% | 147 | 18 | 146 | −41 | 0.24 |
| 5 | E | " | 0.5 mol | 2.0 | Isopalmitic acid | 67% | 890 | 71 | 160 | −28 | 0.28 |
| | | | Dimer 1 | | | | | | | | |
| 6 | F | Neopentylglycol | 0.5 mol | 1.0 | $C_6$—$C_{12}$—FS | 50% | 613 | 54 | 157 | −22 | 0.25 |
| 7 | G | Pentaery- | 0.5 mol | 3.0 | " | 75% | 896 | 77 | 170 | −20 | 0.27 |

TABLE I-continued

| NEUTRAL COMPLEX ESTERS PRODUCED | | | | | | | | | | |
|---|---|---|---|---|---|---|---|---|---|---|
| Example | Product | Polyol (1 Mol) | Polymerized Fatty Acid | Monocarboxylic Acid | Proportion Esterified Therewith | Viscosity (cSt) 37.8° 99° C | | Viscosity Index | Pour Point (0° C) | Acid Number |
| | | thritol | | | | | | | | |

*Dimer 1 = Dimeric fatty acid mixture with proportions given in Example 1.
**Dimer 2 = Dimeric fatty acid mixture with approximately 75% by weight dimerized fatty acids, approximately 22% by weight trimerized fatty acids, and approximately 3% by weight of non-polymerized unsaturated fatty acids, likewise of olefinically-unsaturated fatty acids having 16 to 18 carbon atoms.
***$C_6$—$C_{12}$—FS = Fatty acid mixture from the pre-run of the coconut fatty acid distillation having proportions as given in Example 1.

EXAMPLE 8

USE

Ageing tests at high temperatures were carried out with a lubricating oil manufactured on the basis of the complex esters in accordance with the present invention, and with a commercially available lubricating oil. In addition, the compatibility of those oils with various seal materials also was tested. A commercially available single grade oil of the class SAE 80 and a multi-grade oil, in accordance with the present invention of the specification SAE 80 W-90 were used in the tests. The composition of the oil in accordance with the present invention was as follows:

93.5% by weight of Product D of Example 4 (complex ester of 1 mol of trimethylolpropane, 0.3 mol of dimeric fatty acid and 2.4 mol of $C_6$–$C_{12}$ pre-run fatty acid), 6.5% by weight of a commercially available transmission oil additive (ANGLAMOL 99 of Lubrizol).

The characteristic data of the oil in accordance with the present invention given in Table II show that the additive used did not contain any agent for lowering the pour point and any V.I. improver.

TABLE II

| CHARACTERISTIC DATA OF THE LUBRICATING OILS TESTED | | |
|---|---|---|
| Characteristic Value | In Accordance With Invention | Commercially Available |
| Kin. viscosity at 37.8° C | 147 cSt | 115.4 cSt |
| Kin. viscosity at 98.9° C | 18 cSt | 11.5 cSt |
| Dyn. viscosity at −26.1° C | 25,000 cP | solid |
| Viscosity index | 146 | 94 |
| Pour point | −41° C | −19° C |
| Acid number | 0.4 | 2.8 |

(a) Aging Tests

The lubricating oils to be tested were heated to 160° C and 200° C, respectively, for eight hours in a glass flask, a quantity of air being conducted through the flask during this period of time at a rate of 10 liters per hour. The changes in the viscosities and acid numbers were determined from the samples aged at 200° C.

| | In Accordance with Invention | Commercially Available |
|---|---|---|
| Change in viscosity at 99° C (210° F) in percent | +33.2 | +52.7 |
| Increase in acid number | 1.3 | 3.4 |

The lubricant in accordance with the present invention exhibited a substantially smaller degree of aging than the commercially available product.

The bearing capacities of the products aged at 160° C were determined on a frictional wear balance according to Reichert. The wear was determined under a load of 1500 kp/mm² during friction of steel on steel (length of slide path 100 mm).

| | In Accordance With Invention | Commercially Available |
|---|---|---|
| Bearing capacity of the aged sample (kg/cm²) | 1,250 | 750 |

(b) Swelling Behavior of Seal Materials

In accordance with the regulations laid down by DIN 53, 521, various seal materials were immersed for 70 hours in the lubricating oils which were to be tested and which had been heated to 100° C. The increase in weight of the seal materials was subsequently determined.

| | Increase in Weight After Swelling in Percent | |
|---|---|---|
| Seal Material | In Accordance With Invention | Commercially Available |
| Rubber (NBR 61679) | 11.7 | 15.5 |
| Silicone | 10.7 | 13.2 |

The lubricating oils, in accordance with the present invention based on complex esters also gave better results in this test and, with the seal materials tested, lead to less swelling than is the case with known commercially available oils.

The preceding specific embodiments are illustrative of the practice of the invention. It is to be understood, however, that other expedients known to those skilled in the art, or disclosed herein, may be employed without departing from the spirit of the invention or the scope of the appended claims.

We claim:

1. A high viscosity neutral complex polyester lubricant produced by esterifying a mixture of (a) a branched alkanepolyol having 2 to 4 primary hydroxyls and 4 to 10 carbon atoms, (b) polyacids produced by the dimerization and trimerization of unsaturated fatty acids having 16 to 18 carbon atoms, wherein said polyacids are a mixture containing at least 75% of dimeric fatty acids, and (c) alkanoic acids having 6 to 16 carbon atoms selected from the group consisting of (1) mixtures of saturated fatty acids having 6 to 12 carbon atoms, and (2) alkanoic acids having 12 to 16 carbon atoms and having a branched chain in the α-position to the carboxyl group, in such proportions that the acid number of said polyester is 0.3 or below, the hydroxyl number of said polyester is 0.5 or below, and the proportion of said hydroxyl groups being esterified by said alkanoic acid is from 50% to 90%.

2. The complex polyester lubricant of claim 1 wherein said branched alkanepolyol is a member selected from the group consisting of neopentyl glycol, trimethylolethane, trimethylolpropane and pentaerythritol.

3. The complex polyester lubricant of claim 1 wherein said branched alkanepolyol is trimethylolpropane.

4. The complex polyester lubricant of claim 1 wherein said alkanoic acid is a mixture of saturated fatty acids having 6 to 12 carbon atoms obtained as a first cut from the distillation of a coconut fatty acid.

5. The complex polyester lubricant of claim 1 wherein said alkanoic acid is isopalmitic acid obtained by oxidation of 2-hexyl-decanol obtained by Guerbet synthesis of octanol.

6. In the process of lubricating comprising the step of interposing a layer of a lubricant between moving solid parts, the improvement consisting of using the complex polyester lubricant of claim 1, as said lubricant.

7. A lubricant composition comprising at least 10% by weight of the complex polyester lubricant of claim 1.

8. The complex polyester lubricant of claim 1 having a viscosity at 37.8° C of from 113 to 896 centiStokes, a Viscosity Index of from 146 to 170, and a pour point of from −59° C to −20° C.

* * * * *